US009809909B2

(12) United States Patent
Melgaard

(10) Patent No.: US 9,809,909 B2
(45) Date of Patent: Nov. 7, 2017

(54) FIBER OXIDATION OVEN WITH MULTIPLE INDEPENDENTLY CONTROLLABLE HEATING SYSTEMS

(71) Applicant: Illinois Tool Works Inc., Glenview, IL (US)

(72) Inventor: Hans L. Melgaard, North Oaks, MN (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 15/392,257

(22) Filed: Dec. 28, 2016

(65) Prior Publication Data

US 2017/0107646 A1 Apr. 20, 2017

Related U.S. Application Data

(63) Continuation of application No. 14/257,383, filed on Apr. 21, 2014, now Pat. No. 9,598,795.

(Continued)

(51) Int. Cl.
*F27D 7/00* (2006.01)
*F27D 7/02* (2006.01)

(Continued)

(52) U.S. Cl.
CPC ..... *D01F 9/322* (2013.01); *D01F 9/324* (2013.01); *D01F 9/328* (2013.01); *F27D 7/02* (2013.01); *F27D 11/00* (2013.01)

(58) Field of Classification Search
CPC ..... F27D 7/00; F27D 7/02; F27D 7/04; F27D 11/00; D02J 3/00; D02J 13/001; D02J 13/006

(Continued)

(56) References Cited

U.S. PATENT DOCUMENTS 3,323,475 A 6/1967 Melgaard
3,431,002 A 3/1969 Melgaards (Continued)

FOREIGN PATENT DOCUMENTS

CN 201537998 U 8/2010
EP 0848090 A2 6/1998

(Continued)

OTHER PUBLICATIONS

English translation of CN 201537998 to Rong-hua Zou, published 2010.

(Continued)

*Primary Examiner* — Michael Laflame, Jr.
(74) *Attorney, Agent, or Firm* — McAndrews, Held & Malloy, Ltd.

(57) ABSTRACT

An example oven for heating fibers includes a chamber having upper and lower portions and a supply structure between first and second ends of the chamber, wherein the supply structure is in communication with a first heating system and is configured to direct first heated gas from the first heating system into the upper portion of the chamber to heat fibers in the upper portion at a first temperature, and wherein the supply structure is in communication with a second heating system and is configured to direct second heated gas from the second heating system into the lower portion of the chamber to heat fibers in the lower portion at a second temperature different than the first temperature such that the upper and lower portions of the chamber maintain the different temperatures without a physical barrier between the upper and lower portion.

20 Claims, 7 Drawing Sheets

Related U.S. Application Data

(60) Provisional application No. 61/816,376, filed on Apr. 26, 2013.

(51) Int. Cl.

| | |
|---|---|
| ***F27D 7/04*** | (2006.01) |
| ***D02J 13/00*** | (2006.01) |
| ***D01F 9/32*** | (2006.01) |
| ***F27D 11/00*** | (2006.01) |

(58) Field of Classification Search
USPC ..... 219/391–413; 432/8–12, 18, 21, 24
See application file for complete search history.

(56) References Cited

U.S. PATENT DOCUMENTS

| | | | |
|---|---|---|---|
| 3,727,324 | A | 4/1973 | Melgaard |
| 3,782,892 | A | 1/1974 | Johnson |
| 3,872,473 | A | 3/1975 | Melgaard |
| 4,032,289 | A | 6/1977 | Johnson |
| 4,100,004 | A | 7/1978 | Moss |
| 4,116,612 | A | 9/1978 | Melgaard |
| 4,208,572 | A | 6/1980 | Melgaard |
| 4,322,964 | A | 4/1982 | Melgaard |
| 4,361,744 | A | 11/1982 | Mercier |
| 4,389,387 | A | 6/1983 | Miyamori |
| 4,515,561 | A | 5/1985 | Melgaard |
| 4,729,246 | A | 3/1988 | Melgaard |
| 4,802,843 | A | 2/1989 | Chilva |
| 4,821,866 | A | 4/1989 | Melgaard |
| 4,831,746 | A | 5/1989 | Kim |
| 4,846,669 | A | 7/1989 | Melgaard |
| 5,263,265 | A | 11/1993 | Melgaard |
| 5,431,491 | A | 7/1995 | Melgaard |
| 5,436,569 | A | 7/1995 | Melgaard |
| 5,446,289 | A | 8/1995 | Shodeen |
| 5,516,489 | A | 5/1996 | Melgaard |
| 5,525,295 | A | 6/1996 | Pflug et al. |
| 5,788,484 | A | 8/1998 | Melgaard |
| 6,036,793 | A | 3/2000 | Melgaard |
| 6,048,493 | A | 4/2000 | Melgaard |
| 6,116,895 | A | 9/2000 | Onuschak |
| 6,129,879 | A | 10/2000 | Bersted |
| 6,455,815 | B1 | 9/2002 | Melgaard |
| 6,514,072 | B1 | 2/2003 | Bencic |
| 6,552,560 | B2 | 4/2003 | Melgaard |
| 6,879,779 | B2 | 4/2005 | Melgaard |
| 6,890,246 | B2 | 5/2005 | Yamaharu |
| 7,223,376 | B2 | 5/2007 | Panter |
| 7,514,650 | B2 | 4/2009 | Melgaard |
| 8,007,276 | B2 | 8/2011 | Melgaard |
| 8,308,356 | B2 | 11/2012 | Melgaard |
| 2007/0137259 | A1 | 6/2007 | Borders |
| 2008/0057686 | A1 | 3/2008 | Melgaard |
| 2008/0314892 | A1 | 12/2008 | Graham |
| 2011/0212010 | A1 | 9/2011 | Bell |
| 2012/0189968 | A1 | 7/2012 | Warner |
| 2012/0260518 | A1 | 10/2012 | Melgaard |
| 2012/0264072 | A1 | 10/2012 | Tandon |
| 2013/0098904 | A1 | 4/2013 | Harada |

FOREIGN PATENT DOCUMENTS

| | | | |
|---|---|---|---|
| JP | 2010002176 | A | 1/2010 |
| JP | 2010100967 | A | 5/2010 |
| JP | 2010223471 | A | 10/2010 |

OTHER PUBLICATIONS

International Searching Authority, "International Search Report from PCT Application No. PCT/US2014/035326 dated Oct. 16, 2014", "from Foreign Counterpart of U.S. Appl. No. 14/257,383", dated Oct. 16, 2014, pp. 1-11, Published in: WO.

Kazuyuki, "Horizontal Heat Treatment Apparatus for Yarn and Method for Manufacturing Carbon Fiber", Jul. 1, 2010, pp. 1-6, Published in: JP.

Masatoshi, "Heat-Treatment Furnace, Flame Retardant Fiber Bundle, and Method for Producing Carbon Fiber", Jun. 5, 2010, pp. 1-7, Published in: JP.

Masatoshi, "Heat Treatment Furnace, and Method of Manufactuing Flame Resistant Fiber Bundle and Carbon Fiber", Jul. 10, 2010, pp. 1-6, Published in: JP.

FIBER OXIDATION OVEN WITH MULTIPLE INDEPENDENTLY CONTROLLABLE HEATING SYSTEMS

CROSS-REFERENCE TO RELATED APPLICATION

This application claims the benefit of U.S. patent application Ser. No. 14/257,383, filed Apr. 21, 2014, which claims priority to U.S. Provisional Patent Application Ser. No. 61/816,376, filed Apr. 26, 2013. The entireties of U.S. patent application Ser. No. 14/257,383 and U.S. Provisional Patent Application Ser. No. 61/816,376 are incorporated herein by reference.

BACKGROUND

Oxidation ovens are commonly used to produce carbon fibers from a precursor (such as an acrylic, pitch, or cellulose fibers). One common processing method involves successively drawing fibrous segments of the precursor material through one or more oxidation ovens.

Each of the oxidation ovens comprises a respective oxidation chamber in which the oxidation of the fiber segments takes place. Each fibrous segment can be drawn into a first oxidation oven at a first end as a carbon fiber precursor and then make multiple passes through each oxidation oven prior to exiting the final oxidation oven as an oxidized fiber segment. Roll stands and tensioners are used to draw the fibrous segments through the oxidation chambers of the ovens. Each oxidation oven heats the segments to a temperature approaching approximately 300° C. by means of a circulating flow of hot gas.

An example of such an oven is the Despatch Carbon Fiber Oxidation Oven, available from Despatch Industries, Minneapolis, Minnesota. A description of such an oven can be found in commonly-assigned U.S. Pat. No. 4,515,561. The oven described in the '561 Patent is a "center-to-ends" oxidation oven. In a center-to-ends oxidation oven, hot gas is supplied to the oxidation chamber of the oven from the center of the chamber and flows toward the ends of the chamber.

Typically, such a center-to-ends oxidation oven employs a single heating system to supply heated gas to the oxidation chamber of that oven. While some processing lines make use of multiple stacked oxidation ovens in a single processing line (where fiber exits one oven and enters the other oven), each of the stacked oxidation ovens uses a single heating system. That is, the heated gas supplied to the oxidation chamber of each stacked oven is supplied from a single heating system.

SUMMARY

One embodiment is directed to an oven for heating fibers. The oven comprises a plurality of walls forming a chamber and a supply structure disposed within the chamber between first and second ends of the chamber. The supply structure is in communication with a first heating system and is configured to direct heated gas from the first heating system into a first portion of the chamber. The supply structure is in communication with a second heating system and is configured to direct heated gas from the second heating system into a second portion of the chamber.

Another embodiment is directed to a method of heating fibers using an oven in which a chamber is formed. The method comprises heating gas using a first heating system and heating gas using a second heating system. The method further comprises supplying the heated gas from the first heating system into a first portion of the chamber, and supplying the heated gas from the second heating system into a second portion of the chamber.

DRAWINGS

DETAILED DESCRIPTION

Figure 1:
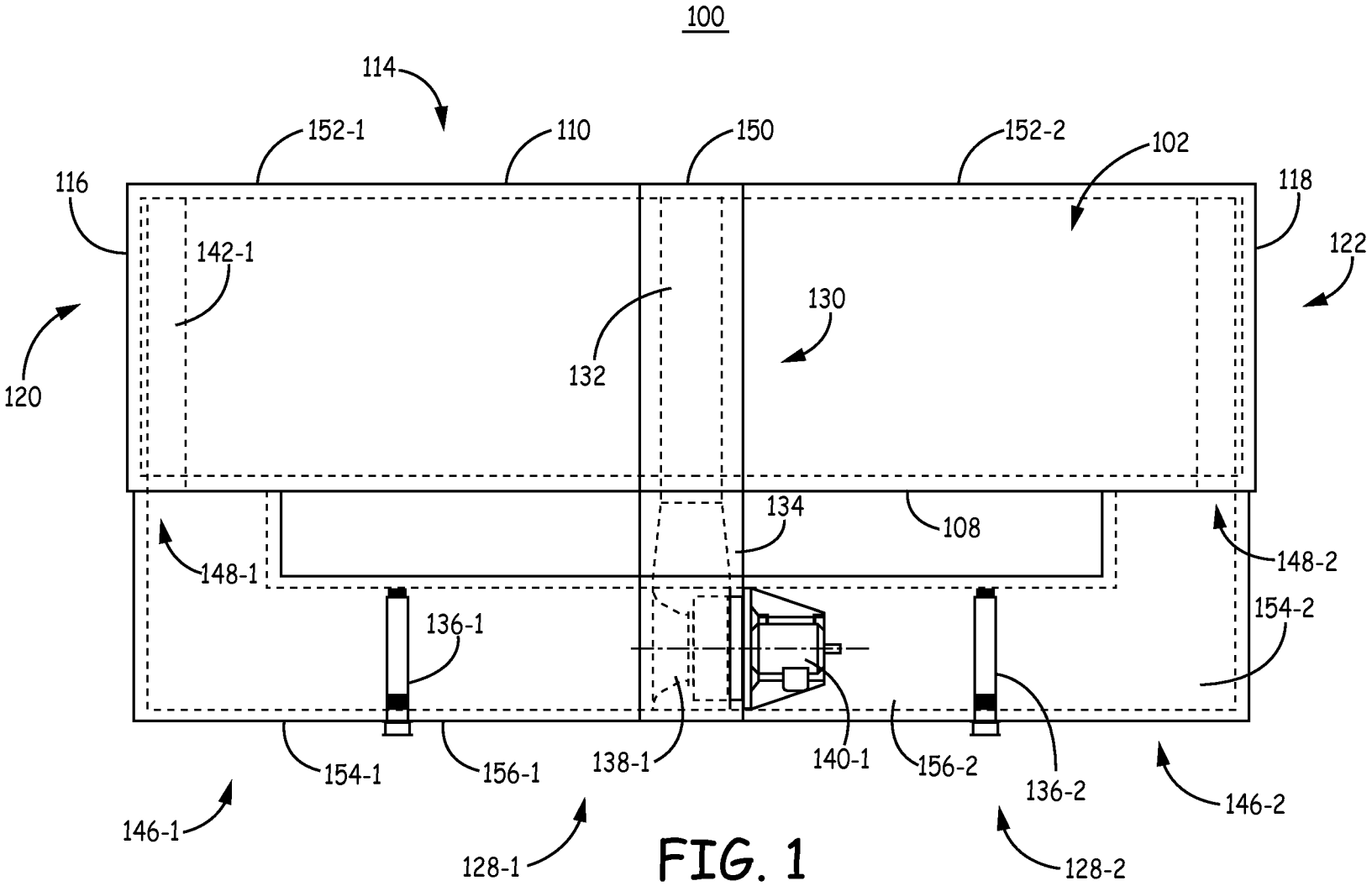
FIG. 1 is a cross-sectional, plan view of one exemplary embodiment of an oxidation oven.

FIGS. 1-5 illustrate one exemplary embodiment of an oxidation oven 100. The oxidation oven 100 is suitable for use in producing carbon fibers using an oxidation process of the type described above. For example, the exemplary embodiment of an oxidation oven 100 shown in FIGS. 1-5 can be used in oxidation processes that make use of one or multiple ovens (for example, in a stacked configuration) as is known to those of skill in the art.

One of ordinary skill in the art will recognize that, for the sake of brevity and clarity, various conventional features used in oxidation ovens have been omitted from the figures and the following description. Examples of such features include, without limitation, baffles, ducts, vanes, vents, and the like used to adjust the flow of gas within the oven 100, vestibules and exhaust features to reduce the discharge of undesirable processes gases into the ambient environment, and/or insulation, louvers, and other thermal features to improve the thermal efficiency of the oven 100. It is to be understood that the exemplary oven 100 shown in FIGS. 1-5 can include such features In the exemplary embodiment shown in FIGS. 1-5, the oven 100 comprises an oven chamber 102 in which the oxidation of fiber segments take place. In this exemplary embodiment, the oven chamber 102 is defined by a plurality of walls. The walls that define the oxidation chamber 102 include a top wall 104 (shown in FIG. 2), a bottom wall 106 (shown in FIG. 2), two side walls 108 and 110 along respective sides 112 and 114 of the chamber 102, and two end walls 116 and 118 at respective ends 120 and 122 of the chamber 102. A respective entry (not shown) is formed in each of the end walls 116 and 118. Each entry is formed by a plurality of slots, which extend between first and second sides 112 and 114 of the chamber 102, and through which the fibrous segments heated by the oxidation over 100 are drawn. The entries and slots can be formed in a conventional manner.

The oven 100 is configured to use multiple independent heating systems 128. Each heating system 128 is used to supply heated gas into the chamber 102. In this exemplary embodiment, two independent heating systems 128 are used, though it is to be understood that more than two independent heating systems 128 can be used. In the following description, the heating systems 128 are referred to here individually as the "first" and "second" heating systems 128 and are individually referenced using reference numerals 128-1 and 128-2, respectively. Also, in the exemplary embodiment shown in FIGS. 1-5, the gas that is used is ambient air.

The oven 100 includes a supply structure 130 disposed within the interior of the chamber 102 between the ends 120 and 122 of the chamber 102. In the exemplary embodiment shown in FIGS. 1-5, the oven 100 is a center-to-ends oxidation oven in which heated gas is supplied from the center of the oxidation chamber 102 towards the ends 120 and 122 of the chamber 102. In this exemplary embodiment, the supply structure 130 is disposed within the interior of the chamber 102 at or near the center of the chamber 102 between the ends 102 and 122 and is also referred to here as the "center supply structure 130."

In the exemplary embodiment shown in FIGS. 1-5, the center supply structure 130 comprises a plurality of nozzles 132 that are stacked one above the other. Each nozzle 132 is configured to direct the flow of the received heated gas in approximately horizontal and parallel streams of heated gas towards both ends 120 and 122 of the oxidation chamber 102. Gaps are provided between the nozzles 132 to enable the fibrous segments between the nozzles 132.

The supply structure 130 and nozzles 132 can be implemented in various ways. For example, in the embodiment shown in FIGS. 1-5, each nozzle 132 is generally rectangular in cross section and extends horizontally between, but spaced from the side walls 108 and 110. Each nozzle 132 has openings formed along both sides of the nozzle 132 that face the ends 120 and 122 of the chamber 102. The openings extend across the width of the nozzle 132. The openings are constructed and arranged so as to direct the flow of the received heated gas in approximately horizontal and parallel streams of heated gas toward the ends 120 and 122 of the oxidation chamber 102. The streams of gas are directed alongside each fibrous segment that traverses that portion of the oxidation chamber 102.

Each of the heating systems 128 is used to supply heated gas to a respective different subset of the nozzles 132 in the center supply structure 130. That is, in the exemplary embodiment shown in FIGS. 1-5, the first heating system 128-1 is used to supply heated gas to a first subset of the nozzles 132 (which are separately referred to here as the "first nozzles 132-1"), and the second heating system 128-2 is used to supply heated gas to a second subset of the nozzles 132 (which are separately referred to here as the "second nozzles 132-2"). Each of the first nozzles 132-1 is in fluid communication at one or both of its ends with a first supply duct 134-1 in order to receive heated gas from the first heating system 128-1. Likewise, each of the second nozzles 132-2 is in fluid communication at one or both of its ends with a second supply duct 134-2 in order to receive heated gas from the second heating 128-2.

The first and second supply ducts 134-1 and 134-2 can be appropriately tapered or provided with adjustable slots or other features (not shown) so that the velocity of heated gases exiting the nozzles 132 is substantially uniform.

In the exemplary embodiment shown in FIGS. 1-5, the first nozzles 132-1 are in an upper portion of the oxidation chamber 102 and are also referred to here as the "upper nozzles 132-1." Likewise, in this exemplary embodiment, the second nozzles 132-2 are in a lower portion of the oxidation chamber 102 and are also referred to here as the "lower nozzles 132-2."

Each of the multiple independent heating systems 128 can be independently controlled (for example, using one or more suitable controllers such as proportional-integral-derivative (PID) controllers). That is, each of the heating systems 128 can be operated to heat gas to a target temperature that differs from the target temperatures at which the other heating systems 128 are operated. This provides additional process variables that can be adjusted in order to further refine the overall oxidation process.

As noted above, the fibers that are heated in the oven 100 make multiple passes through the chamber 102. For each pass though the chamber 102, the fibers enter the chamber 102 via a slot on one side and exit the chamber 102 through a slot on the other side, with, for example, roll stands and tensioners being used to draw the fibers through the chamber 102. In one example, the multiple passes start at the bottom and go from bottom to top (though it is to be understood that other embodiments can be implemented in other ways). In one such example, where the first heating system 128-1 is used to supply heated gas to the upper portion of the chamber 102, where the second heating systems 128-2 is used to supply heated gas to the lower portion of the chamber 102, and where the multiple passes of the fibers through chamber 102 go from bottom to top, the first heating system 128-1 can be operated at target temperature that is slightly higher (for example, 1-5 degrees Celsius) than the target temperature at which the second heating system 128-2 is operated. In this way, a slight temperature difference can be established between the upper and lower portions of the chamber 102. As a consequence, the speed at which the fibrous segments can be run through the oven 100 can be increased since the higher temperature in the upper portion shortens the required residence time. This can be done without using of a physical barrier between the upper and lower portions of the chamber 102 since the fibrous segments that pass between the upper and lower nozzles 132-1 and 132-2 typically provide sufficient thermal isolation between the upper and lower portions of the chamber 102 to maintain different temperatures in the upper and lower portions of the chamber 102. In some common applications, each degree Celsius by which the temperature of the upper portion of the chamber 102 is increased relative to the temperature of the lower portion of the chamber 102 can result in at least a one percent increase in line speed.

The multiple independent heating systems 128 can be operated in other ways.

The heating systems 128 can be implemented in various ways. In the exemplary embodiment shown in FIGS. 1-5, each of the heating systems 128 is implemented using at least one heater 136, a respective blower 138 to draw gas through the respective heater 136, and a respective motor 140 to power the corresponding blower 138. Each heater 136 can be implemented in various ways. For example, each heater 136 can be implemented using one or more heating elements. Also, each heater 136 can be implemented using an indirect gas heater, an electric heater, or combinations thereof. Each heater 136 can be implemented in other ways.

By using multiple heating systems 128 to supply heated gas to the center supply structure 130, it is possible to use components of the heating systems 128 (that is, the heaters 136, blowers 138, and/or motors 140) that are smaller than those that would otherwise be used in an oven employing only a single heating system. This can reduce the cost of the overall oven 100 and/or make it easier to assemble and service the heating systems 128.

Each oven 100 also includes two return structures 142-1 and 142-2 within the oxidation chamber 102. The first return structure 142-1 is positioned near the first end wall 116. The second return structure 142-2 is positioned near the second end wall 118. Each of the return structures 142-1 and 142-2 includes a plurality of return channels (not shown) that are each stacked one above another and that are positioned to generally correspond with the positions of corresponding nozzles 132 of the center supply structure 130. Gaps are provided between the return channels to enable passage of fibrous segments between the return channels.

The return channels of the first return structure 142-1 are configured to receive at least a portion of the gas directed from the center supply structure 130 toward the first end wall 116. That is, the first return structure 142-1 receives gas directed from both the lower and upper nozzles 132-1 and 132-2 of the center supply structure 130 toward the first end wall 116. Similarly, the return channels of the second return structure 142-2 are configured to receive at least a portion of gas directed from the center supply structure 130 toward the second end wall 122. That is, the second return structure 142-2 receives gas directed from both the lower and upper nozzles 132-1 and 132-2 of the center supply structure 130 toward the second end wall 118.

Figure 2:
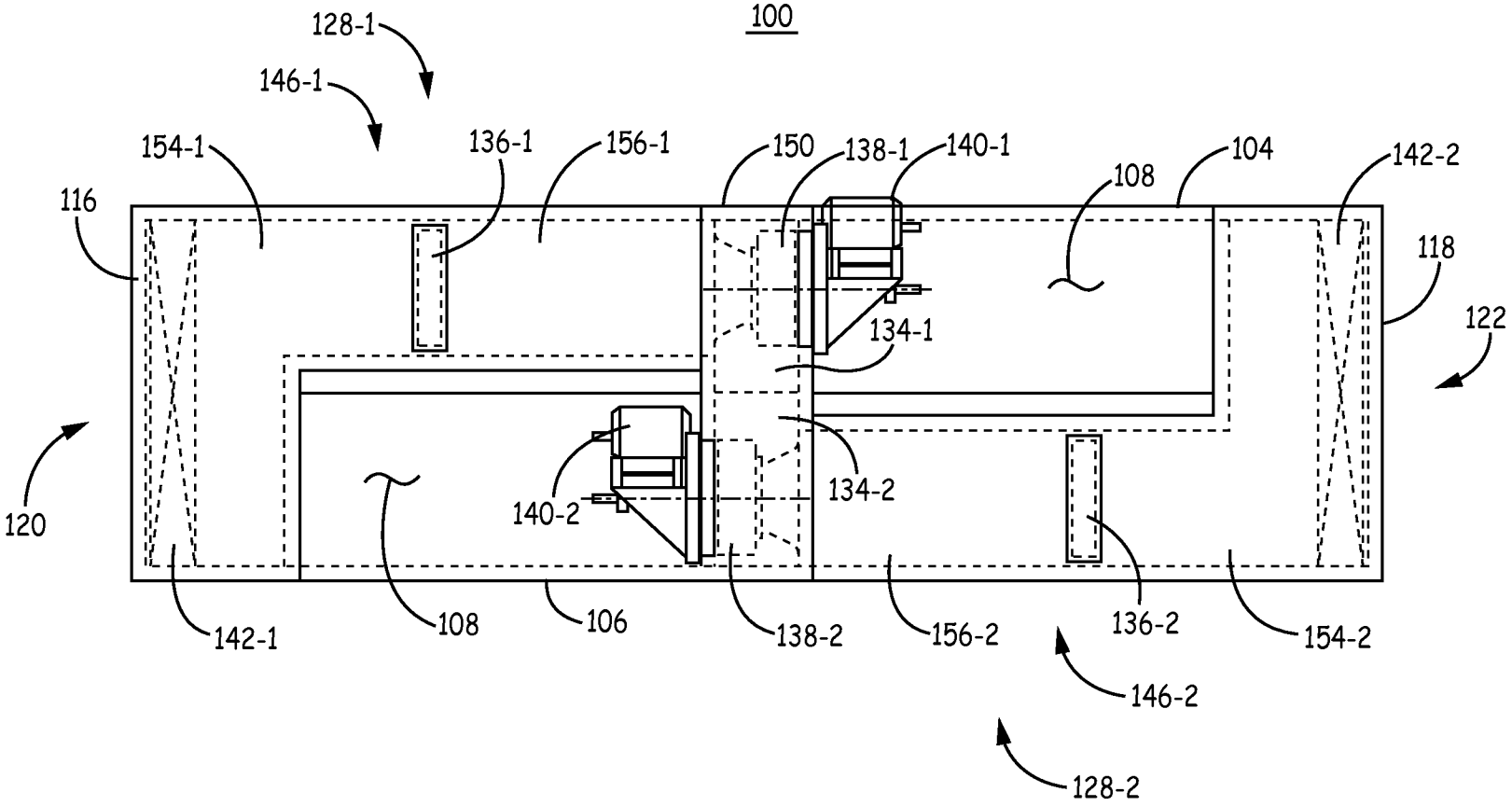
FIG. 2 is a side view of the oxidation oven shown in FIG. 1.
Figure 3:
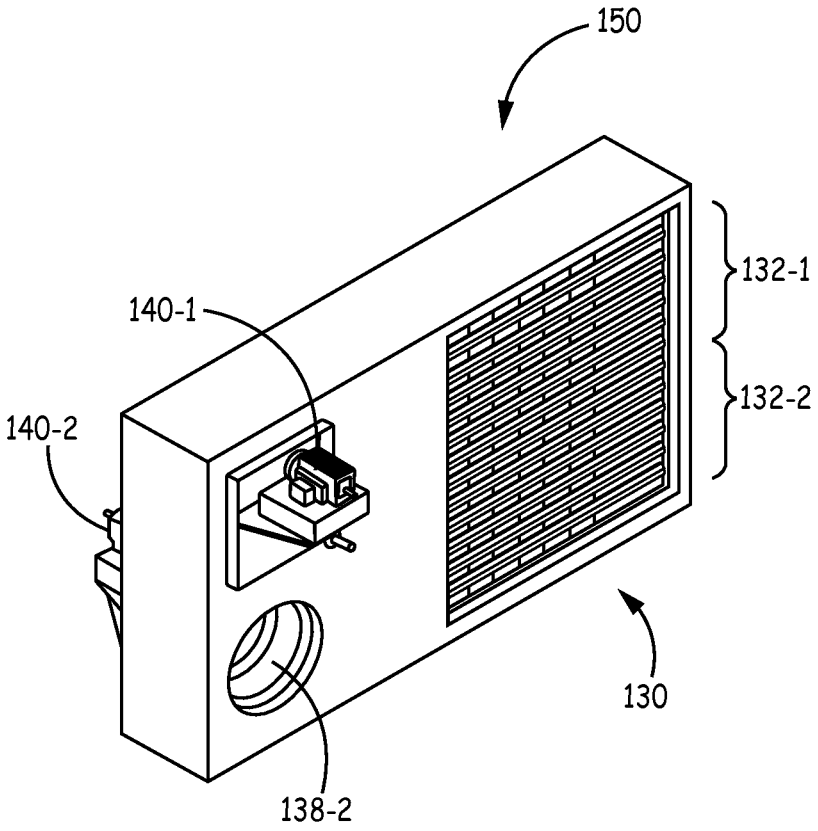
FIG. 3 is a perspective view of the center module from the oxidation oven shown in FIG. 1.
Figure 4:
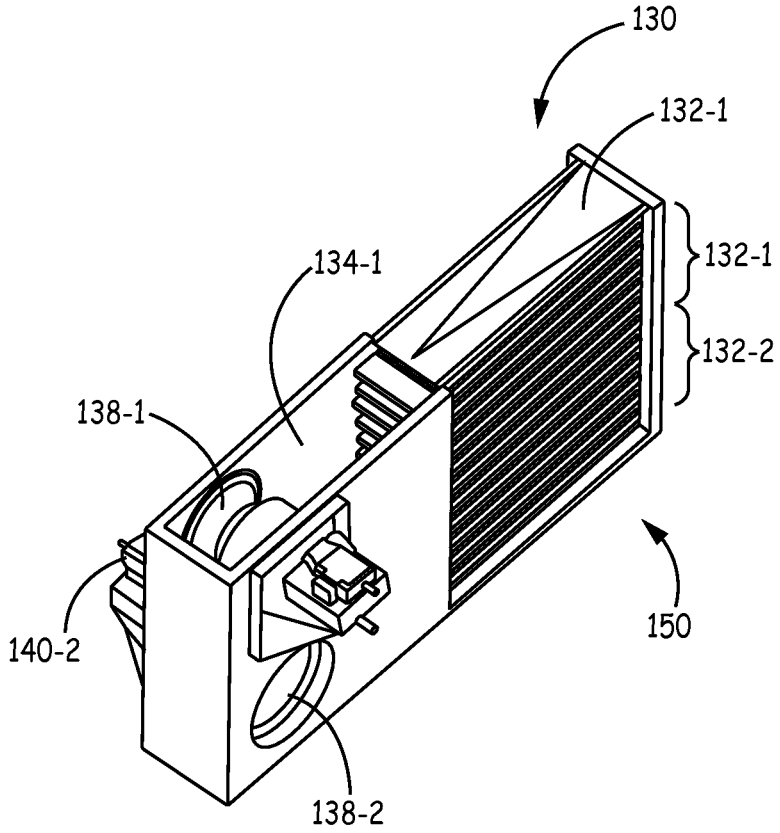
FIG. 4 is a perspective view of the center module from the oxidation oven shown in FIG. 1 with the top wall removed.
Figure 5:
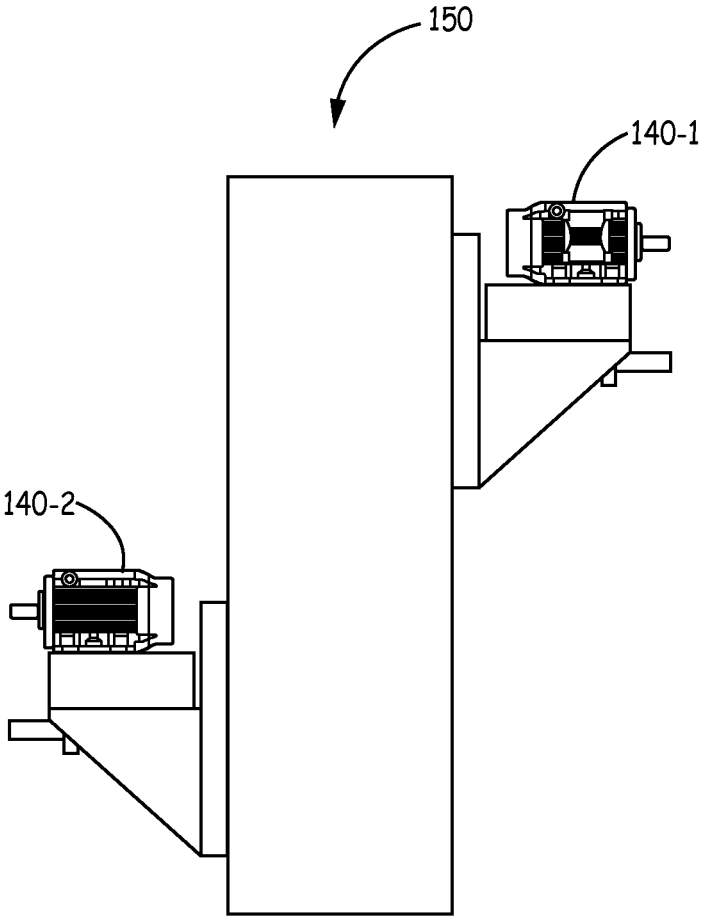
FIG. 5 is a side view of the center module shown in FIGS. 4 and 5.

As shown in FIGS. 1-2, a first return duct 146-1 is used to establish fluid communication between the first return structure 142-1 and the first heating system 128-1. In this way, at least a portion of the heated gas received by the first return structure 142-1 is directed back to the first heating system 128-1 to be heated and supplied to the first nozzles 132-1 via the first supply ducts 134-1 as described above. Likewise, a second return duct 146-2 is used to establish fluid communication between the second return structure 142-2 and the second heating system 128-2. In this way, at least a portion of the heated gas received by the second return structure 142-2 is directed back to the second heating system 128-2 to be heated and supplied to the second nozzles 132-2 via the second supply ducts 134-2 as described above.

In the exemplary embodiment shown in FIGS. 1-5, return ducts 146-1 and 146-2 are located outside of the walls of the chamber 102. However, it is to be understood that the return ducts 146-1 and 146-2 can be implemented in other ways (for example, the return ducts can be implemented within the walls of the chamber 102). In the exemplary embodiment shown in FIGS. 1-5, the first return structure 142-1 directs at least a portion of the gas received from the center supply structure 130 out of a respective return outlet 148-1 formed in the side wall 108 of the chamber 102. This return outlet 148-1 is also referred to here as the "first return outlet 148-1." Likewise, the second return structure 142-2 directs at least a portion of the gas received from the center supply structure 130 out of a respective return outlet 148-2 formed in the side wall 108 of the chamber 102. This return outlet 148-2 is also referred to here as the "second return outlet 148-2."

In the exemplary embodiment shown in FIG. 1-5, the oven 100 is implemented in a modular manner The chamber 102 is implemented using three modules. The chamber 102 is implemented using a center module 150 that houses the center supply structure 130. The chamber 102 also includes two end modules 152, each of which houses a respective one of the return structures 142.

In this exemplary embodiment, each heater 136 is implemented within the corresponding return duct 146. More specifically, each return duct 146 is implemented in two modules. Each return duct 146 includes a respective first module 154 that is connected at one end to the side wall 108 of the chamber 102 and is in fluid communication with a respective one of the return outlets 148. Each such first module 154 is also connected at the other end to an inlet of the corresponding heater 136. Each return duct 146 also includes a respective second module 156 that is connected at one end to the outlet of the corresponding heater 136 and that is connected at the other end to the inlet of a corresponding blower 138.

In this exemplary embodiment, the center module 150 is configured to also house the blowers 138 and supply ducts 134 for both of the heating systems 128. As shown in FIGS. 1 and 2, the corresponding motor 140 for each heating system 128 is also mounted to the outside of the central module 150 using, for example, a bracket or similar mounting structure.

By implementing the heaters 136 in the return ducts 146, the same central module 150 (which houses the blowers 138 and supply ducts 134 for both heating systems 128 and to which the motors 140 are mounted) can be used with different heaters 136 and heater configurations by changing or adjusting the heaters 136 and return ducts 146. That is, different heater configurations can be used with the same center module 150.

In the exemplary embodiment shown in FIGS. 1-5, the blower 138 for each heating system 128 is centered across the nozzles 132 that are supplied by that blower 138. That is, the blower 138-1 in the first heating system 128-1 (which supplies heated gas to the upper nozzles 132-1) is centered among the upper nozzles 132-1, while the blower 138-2 in the second heating system 128-2 (which supplies heated gas to the lower nozzles 132-2) is centered among the lower nozzles 132-2. This centering enables the heated gas supplied by each blower 138 to be more directly supplied to the corresponding nozzles 132, which increases the efficiency of the heating system 128 and oven 100.

As shown in FIG. 2, the horizontal run of the first return duct 146-1 is located along the upper part of the oven 100, while the horizontal run of the second return duct 146-2 is located along the lower part of the oven 100. This arrangement enables the corresponding motors 140 to be more easily accommodated in the overall oven design and to be more easily mounted on the exterior of the center module 150.

As shown in FIG. 1, the horizontal runs of the return ducts 146 are spaced apart from the exterior of the side wall 108. This is done, for example, so that features that are conventionally implemented along the exterior of the side walls of oxidation ovens (such as pressure relief features) can still be implemented along the exterior side wall 108 of the oven 100 even with the use of external return ducts 146.

Figure 6A:
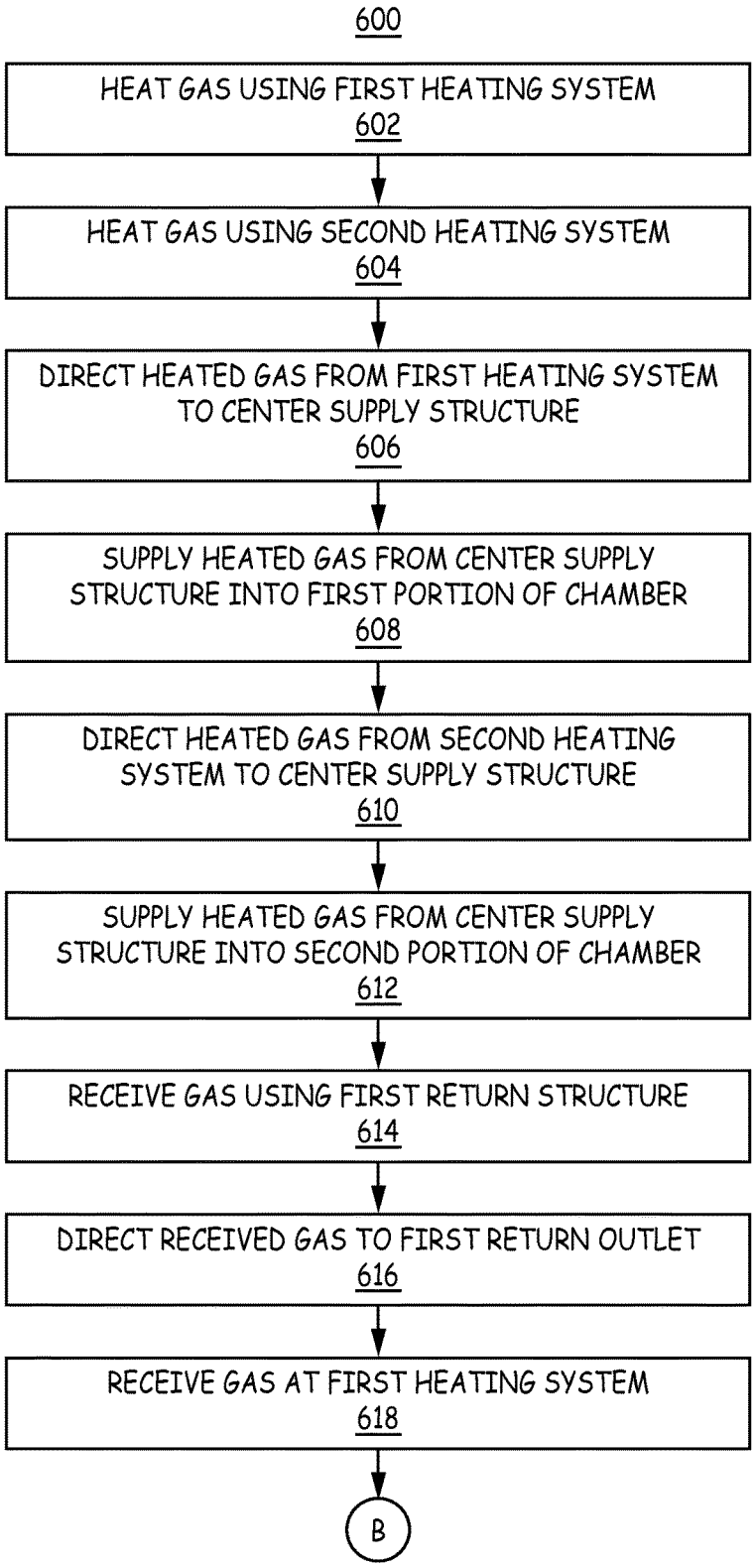
FIGS. 6A-6B are flow diagrams of an exemplary embodiment of a method of heating fibers by contact with heated gas.
Figure 6B:
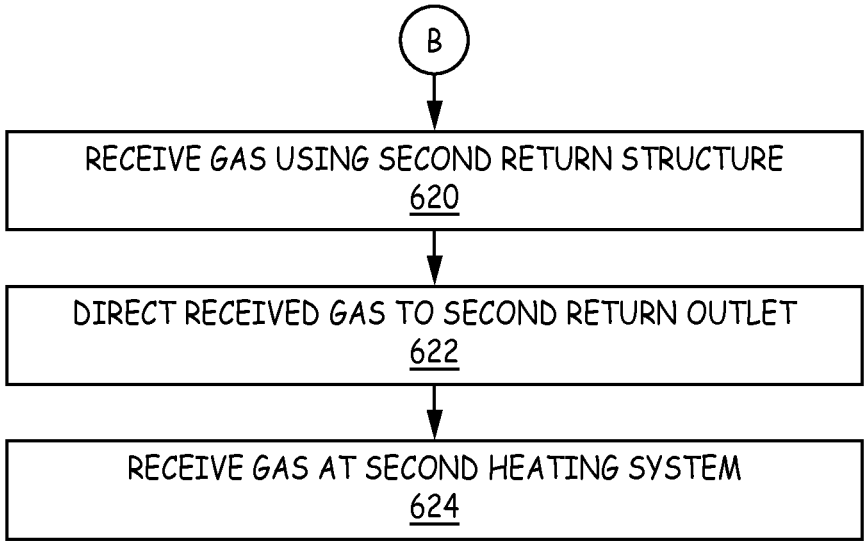

FIGS. 6A-6B are flow diagrams of an exemplary embodiment of a method 600 of heating fibers by contact with heated gas. The embodiment of method 600 shown in FIGS. 6A-6B is described here as being implemented using the exemplary embodiment of an oxidation oven 100 described above in connection with FIGS. 1-5. However, it is to be understood that other embodiments can be implemented in other ways.

Method 600 comprises heating gas using a first heating system 128-1 (block 602 shown in FIG. 6A) and heating gas using a second heating system 128-2 (block 604). In this exemplary embodiment, each of the heating systems 128 includes a respective heater 136 that is used to heat gas drawn through it by a respective blower 138. Also, as described above, the heating systems 128 can be operated at different target temperatures (for example, with a slightly higher target temperature for the heating system 128 that provides heated gas to the upper portion of the chamber 102 than for the heating system 128 that provides heated to the lower portion).

Method 600 further comprises directing the heated gas from the first heating system 128-1 to the center supply structure 130 (block 606) and supplying the heated gas from the center supply structure 130 into a first portion of the interior of the chamber 102 from a location between the first and second ends 120 and 122 of the chamber 102 (block 608). In this exemplary embodiment, the first portion of the interior of the chamber 102 is the upper portion of the chamber 102. Heated gas from the first heating system 128-1 is supplied to the nozzles 132-1 in the center supply structure 130 that are in the upper portion of the chamber 102. The upper nozzles 132-1 supply the heated gas from the center of the chamber 102 towards both the first and second ends 120 and 122 of the chamber 102.

Likewise, method 600 further comprises directing the heated gas from the second heating system 128-2 to the center supply structure 130 (block 610) and supplying the heated gas from the center supply structure 130 into a second portion of the interior of the chamber 102 from a location between the first and second ends 120 and 122 of the chamber 102 (block 612). In this exemplary embodiment, the second portion of the interior of the chamber 102 is the lower portion of the chamber 102. Heated gas from the second heating system 128-2 is supplied to the nozzles 132-1 in the center supply structure 130 that are in the lower portion of the chamber 102. The lower nozzles 132-2 supply the heated gas from the center of the chamber 102 towards both the first and second ends 120 and 122 of the chamber 102.

With method 600, the heated gas that is supplied to the first (upper) portion of the chamber 102 can be heated to a different target temperate than the heated gas that is supplied to the second (lower) portion of the chamber 102. As noted above, this provides additional process variables that can be adjusted in order to further refine the overall oxidation process.

For example, as described above, where the first heating system 128-1 is used to supply heated gas to the upper portion of the chamber 102 and the second heating systems 128-2 is used to supply heated gas to the lower portion of the chamber 102, the first heating system 128-1 can be operated at target temperature that is slightly higher (for example, 1-5 degrees Celsius) than the target temperature at which the second heating system 128-2 is operated. In this way, a slight temperature difference can be established between the upper and lower portions of the chamber 102. As a consequence, the speed at which the fibrous segments can be run through the oven 100 can be increased since the higher temperature in the upper portion shortens the required residence time. This can be done without using of a physical barrier between the upper and lower portions of the chamber 102 since the fibrous segments that pass between the upper and lower nozzles 132-1 and 132-2 typically provide sufficient thermal isolation between the upper and lower portions of the chamber 102 to maintain different temperatures in the upper and lower portions of the chamber 102. As noted above, in some common applications, each degree Celsius by which the temperature of the upper portion of the chamber 102 is increased relative to the temperature of the lower portion of the chamber 102 can result in at least a one percent increase in line speed.

Method 600 further comprises receiving, using a first return structure 142-1 positioned near the first end 120 of the chamber 102, at least a portion of the heated gas directed into the chamber 102 toward the first end 120 (block 614). Method 600 further comprises directing at least a portion of the heated gas received using the first return structure 142-1 to a first return outlet 148-1 formed in a side wall 108 of the chamber 102 (block 616) and receiving, in the first heating system 128-1, at least a portion of the heated gas directed to the first return outlet 148-1 (block 618). In this exemplary embodiment, the gas directed out of the first return outlet 148-1 is directed to the first heating system 128-1 via the first (upper) return duct 146-1. The gas that is returned to the first heating source 128-1 is heated by it and directed to the center supply structure 130 for supplying into the first (upper) portion of the chamber 102 as described above in connection with blocks 602, 606, and 608.

Likewise, method 600 further comprises receiving, using a second return structure 142-2 positioned near the second end 122 of the chamber 102, at least a portion of the heated gas directed into the chamber 102 toward the second end 122 (block 620 shown in FIG. 6B). Method 600 further comprises directing at least a portion of the heated gas received using the second return structure 142-2 to a second return outlet 148-2 formed in a side wall 108 of the chamber 102 (block 622), and receiving, in the second heating system 128-2, at least a portion of the heated gas directed to the second return outlet 148-2 (block 624). In this exemplary embodiment, the gas directed out of the second return outlet 148-2 is directed to the second heating system 128-2 via the second (lower) return duct 146-2. The gas that is returned to the second heating source 128-2 is heated by it and directed to the center supply structure 130 for supplying into the second (lower) portion of the chamber 102 as described above in connection with blocks 604, 610, and 612.

Embodiments of method 600 are suitable for use with modular oxidation ovens of the type described above in connection with FIGS. 1-5 where the return ducts 146 are implemented outside of the walls 104 used to define the chamber 102.

The embodiments described above are merely exemplary and are not intended to be limiting. For example, in the embodiments described above, the nozzles of the center supply structure are supplied from a single side; however, it is to be understood that other types of supply structures can be used (for example, a center supply structure and nozzles that are fed from both sides can be used). Also, in the embodiments described above, the return ducts are implemented outside of the walls of the chamber. However, as noted above, it is to be understood that the return ducts can be implemented in other ways (for example, the return ducts can be implemented at least in part within the walls of the chamber). Furthermore, in the embodiments described above, the heating systems are implemented in a modular manner with the heaters implemented in the return ducts; however, it is to be understood that the heating systems can be implemented in other ways (for example, the heating systems can be implemented in a more conventional non-modular manner).

A number of embodiments have been described. Nevertheless, it will be understood that various modifications to the described embodiments may be made without departing from the spirit and scope of the claimed invention.

EXAMPLE EMBODIMENTS

Example 1 includes an oven for heating fibers, the oven comprising: a plurality of walls forming a chamber; and a supply structure disposed within the chamber between first and second ends of the chamber; wherein the supply structure is in communication with a first heating system and is configured to direct heated gas from the first heating system into a first portion of the chamber; and wherein the supply structure is in communication with a second heating system and is configured to direct heated gas from the second heating system into a second portion of the chamber.

Example 2 includes the oven of Example 1, wherein the first and second portions of the chamber comprise lower and upper portions of the chamber, respectively.

Example 3 includes the oven of any of the Examples 1-2, wherein each of the first and second heating systems comprises: a respective heater; and a respective blower to draw gas through the respective heater.

Example 4 includes the oven of Example 3, wherein the respective heater of each of the first and second heating systems comprises at least one heating element.

Example 5 includes the oven of any of the Examples 3-4, wherein each of the first and second heating systems further comprises a respective motor.

Example 6 includes the oven of any of the Examples 1-5, wherein the supply structure comprises a plurality of nozzles, wherein a first subset of the nozzles are in fluid communication with the first heating system and are used to supply heated gas from the first heating system to the first portion of the chamber and wherein a second subset of the nozzles are in fluid communication with the second heating system and are used to supply heated gas from the second heating system to the second portion of the chamber.

Example 7 includes the oven of any of the Examples 1-6, wherein first and second return outlets are formed in at least one of the plurality of walls that form the chamber; and wherein the oven further comprises: a first return structure positioned near a first end of the chamber and configured to receive at least a portion of the heated gas directed into the chamber, the first return structure configured to direct at least a portion of the received heated gas to the first return outlet; a second return structure positioned near a second end of the chamber and configured to receive at least a portion of the heated gas directed into the chamber, the second return structure configured to direct at least a portion of the received heated gas to the second return outlet; and a first return duct located external to the plurality of walls that form the chamber, the first return duct providing fluid communication between the first return outlet and the first heating system; and a second return duct located external to the plurality of walls that form the chamber, the second return duct providing fluid communication between the second return outlet and the second heating system; and wherein the first heating system is configured to receive at least a portion of the heated gas directed to the first return outlet; and wherein the second heating system is configured to receive at least a portion of the heated gas directed to the second return outlet.

Example 8 includes the oven of any of the Examples 1-7, wherein the first and second heating systems are independently controllable.

Example 9 includes the oven of any of the Examples 1-8, wherein the first heating system is configured to heat gas to a first target temperature and wherein the second heating system is configured to heat gas to a second target temperature that differs from the first temperature.

Example 10 includes a method of heating fibers using an oven in which a chamber is formed, the method comprising: heating gas using a first heating system; heating gas using a second heating system; supplying the heated gas from the first heating system into a first portion of the chamber; and supplying the heated gas from the second heating system into a second portion of the chamber.

Example 11 includes the method of Example 10, further comprising: directing the heated gas from the first heating system to a supply structure disposed between first and second ends of the chamber, wherein supplying the heated gas from the first heating system into the first portion of the chamber comprises supplying, from the supply structure into the first portion of the chamber, the heated gas from the first heating system; and directing the heated gas from the second heating system to the supply structure, wherein supplying the heated gas from the second heating system into the second portion of the chamber comprises supplying, from the supply structure into the second portion of the chamber, the heated gas from the second heating system.

Example 12 includes the method of any of the Examples 10-11, wherein heating gas using the first heating system comprises heating gas using at least one heating element included in the first heating system; and wherein heating gas using the second heating system comprises heating gas using at least one heating element included in the second heating system.

Example 13 includes the method of any of the Examples 10-12, further comprising: receiving, using a first return structure positioned near the first end of the chamber, at least a portion of the heated gas directed into the chamber; directing at least a portion of the heated gas received using the first return structure to a first return outlet formed in the chamber; receiving, in the first heating system, at least a portion of the heated gas directed to the first return outlet; receiving, using a second return structure positioned near the second end of the chamber, at least a portion of the heated gas directed into the chamber; directing at least a portion of the heated gas received using the second return structure to a second return outlet formed in the chamber; and receiving, in the second heating system, at least a portion of the heated gas directed to the second return outlet.

Example 14 includes the method of any of the Examples 10-13, wherein heating gas using the first heating system comprises heating gas using the first heating system to a first target temperature, and wherein heating gas using the second heating system comprises heating gas using the second heating system to a second target temperature, wherein the first target temperature differs from the second target temperature.

Example 15 includes the method of Example 14, wherein the first target temperature is higher than the second target temperature.

What is claimed is:

1. An oven for heating fibers, the oven comprising:

a plurality of walls forming a chamber having an upper portion and a lower portion; and a supply structure disposed within the chamber between first and second ends of the chamber;

wherein the supply structure is in communication with a first heating system located outside of the chamber and is configured to direct first heated gas from the first heating system into the upper portion of the chamber to heat fibers in the upper portion of the chamber at a first temperature; and wherein the supply structure is in communication with a second heating system located outside of the chamber and is configured to direct second heated gas from the second heating system into the lower portion of the chamber to heat fibers in the lower portion of the chamber at a second temperature different than the first temperature such that the upper portion and the lower portion of the chamber maintain the different temperatures without a physical barrier between the upper portion and the lower portion of the chamber.

2. The oven of claim 1, wherein the supply structure comprises a plurality of nozzles, wherein a first subset of the nozzles are in fluid communication with the first heating system and are used to supply the first heated gas from the first heating system to the upper portion of the chamber and wherein a second subset of the nozzles are in fluid communication with the second heating system and are used to supply the second heated gas from the second heating system to the lower portion of the chamber.

3. The oven of claim 1, wherein each of the first and second heating systems comprises:

a respective heater; and a respective blower to draw gas through the respective heater.

4. The oven of claim 3, wherein the respective heater of each of the first and second heating systems comprises at least one heating element.

5. The oven of claim 3, wherein each of the first and second heating systems further comprises a respective motor.

6. The oven of claim 1, wherein first and second return outlets are formed in at least one of the plurality of walls that form the chamber; and wherein the oven further comprises:

a first return structure positioned near a first end of the chamber and configured to receive at least a portion of the first heated gas directed into the chamber, the first return structure configured to direct at least a portion of the received first heated gas to the first return outlet;

a second return structure positioned near a second end of the chamber and configured to receive at least a portion of the second heated gas directed into the chamber, the second return structure configured to direct at least a portion of the received second heated gas to the second return outlet; and a first return duct located external to the plurality of walls that form the chamber, the first return duct providing fluid communication between the first return outlet and the first heating system; and a second return duct located external to the plurality of walls that form the chamber, the second return duct providing fluid communication between the second return outlet and the second heating system; and wherein the first heating system is configured to receive at least a portion of the first heated gas directed to the first return outlet; and wherein the second heating system is configured to receive at least a portion of the second heated gas directed to the second return outlet.

7. The oven of claim 1, wherein the first and second heating systems are independently controllable.

8. The oven of claim 1, wherein the first temperature is higher than the second temperature.

9. The oven of claim 1, wherein the oven comprises a center-to-ends oven.

10. The oven of claim 9, wherein the supply structure is configured to:

supply the heated gas from the first heating system into the upper portion of the chamber from a center of the chamber towards opposite ends of the chamber; and supply the heated gas from the second heating system into the lower portion of the chamber from the center of the chamber towards the opposite ends of the chamber.

11. The oven of claim 9, wherein the supply structure is configured to:

supply the heated gas from the first heating system into the upper portion of the chamber from the center of the chamber towards the opposite ends of the chamber so that the heated gas from the first heating system flows parallel to a direction of travel of the fibers within the chamber; and supply the heated gas from the second heating system into the lower portion of the chamber from the center of the chamber towards the opposite ends of the chamber so that the heated gas from the second heating system flows parallel to the direction of travel of the fibers within the chamber.

12. An oven for heating fibers, the oven comprising:

a chamber having a center supply structure and opposing ends;

a first heating system configured to heat first gas to a first target temperature;

a second heating system configured to heat second gas to a second target temperature;

a first supply system to supply the first gas from the first heating system into an upper portion of the chamber from the center supply structure toward the opposing ends of the chamber to heat fibers in the upper portion of the chamber; and a second supply system to supply the second gas from the second heating system into a lower portion of the chamber from the center supply structure toward the opposing ends of the chamber to heat fibers in the lower portion of the chamber, such that the upper portion and the lower portion of the chamber maintain the different temperatures without a physical barrier between the upper portion and the lower portion of the chamber.

13. The oven of claim 12, wherein the supply structure comprises a plurality of nozzles, wherein a first subset of the nozzles are in fluid communication with the first heating system and are used to supply the first heated gas from the first heating system to the upper portion of the chamber and wherein a second subset of the nozzles are in fluid communication with the second heating system and are used to supply the second heated gas from the second heating system to the lower portion of the chamber.

14. The oven of claim 12, wherein the first heating system and the second heating system are located outside of the chamber.

15. The oven of claim 12, further comprising:

first ductwork configured to return to the first heating system at least a portion of the first gas directed into the chamber; and second ductwork independent of the first ductwork, the second ductwork configured to return to the second heating system at least a portion of the second gas directed into the chamber.

16. The oven of claim 12, wherein the center supply structure is configured to:

supply the first gas from the first heating system into the upper portion of the chamber from the center of the chamber towards the opposite ends of the chamber so that the heated gas from the first heating system flows parallel to a direction of travel of the fibers within the chamber; and supply the second gas from the second heating system into the lower portion of the chamber from the center of the chamber towards the opposite ends of the chamber so that the heated gas from the second heating system flows parallel to the direction of travel of the fibers within the chamber.

17. The oven of claim 12, wherein the first heating system comprises a first heater and a first blower to urge gas through the first heater, and the second heating system comprises a second heater and a second blower to urge gas through the second heater.

18. The oven of claim 12, wherein each of the first heater and the second heater comprises at least one heating element.

19. The oven of claim 12, wherein the first temperature is higher than the second temperature.

20. The oven of claim 12, wherein the first and second heating systems are independently controllable.

* * * * *